US006405634B1

(12) United States Patent
Hansen

(10) Patent No.: US 6,405,634 B1
(45) Date of Patent: Jun. 18, 2002

(54) HYDRAULIC AXIAL PISTON MACHINE

(75) Inventor: Ove Thorbøl Hansen, Nordborg (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 09/698,796

(22) Filed: Oct. 27, 2000

(30) Foreign Application Priority Data

Nov. 9, 1999 (DE) ..... 199 53 766

(51) Int. Cl.[7] ..... F04B 1/20
(52) U.S. Cl. ..... 92/71; 92/128
(58) Field of Search ..... 92/71, 129; 91/499; 417/269

(56) References Cited

U.S. PATENT DOCUMENTS 3,514,223 A * 5/1970 Hare ..... 417/269
3,601,012 A * 8/1971 Oram ..... 91/499
5,220,225 A * 6/1993 Moon, Jr. ..... 417/271 X
5,520,088 A * 5/1996 Dixen ..... 92/71
5,782,161 A * 7/1998 Okubo et al. ..... 92/71

FOREIGN PATENT DOCUMENTS

GB 700824 * 12/1953 ..... 417/269

* cited by examiner

*Primary Examiner*—John E. Ryznic
(74) *Attorney, Agent, or Firm*—Lee, Mann, Smith, McWilliams, Sweeney & Ohlson

(57) ABSTRACT

A hydraulic axial piston machine (1) includes a cylinder drum (3) having at least one cylinder (4) in which a piston (5) is arranged to be reciprocating, an inclined swash plate (8), on which the piston (5) is supported via a slide shoe (7), a pressure plate (9) maintaining the bearing of the slide shoe (7) on the swash plate (8), and a spring arrangement (10) by means of which the pressure plate (9) is pressed against the swash plate (8) via the cylinder drum (3). In the past, the pressure plate has been supported on the cylinder drum (3) via a ball joint, with the spring arrangement and a driving shaft for the cylinder drum penetrating the cylinder drum. The ball joint is expensive and exposed to wear. According to the invention, the spring arrangement (10) bears immediately on the pressure plate (9). Thus, a ball joint and the wear of it will be avoided.

5 Claims, 1 Drawing Sheet

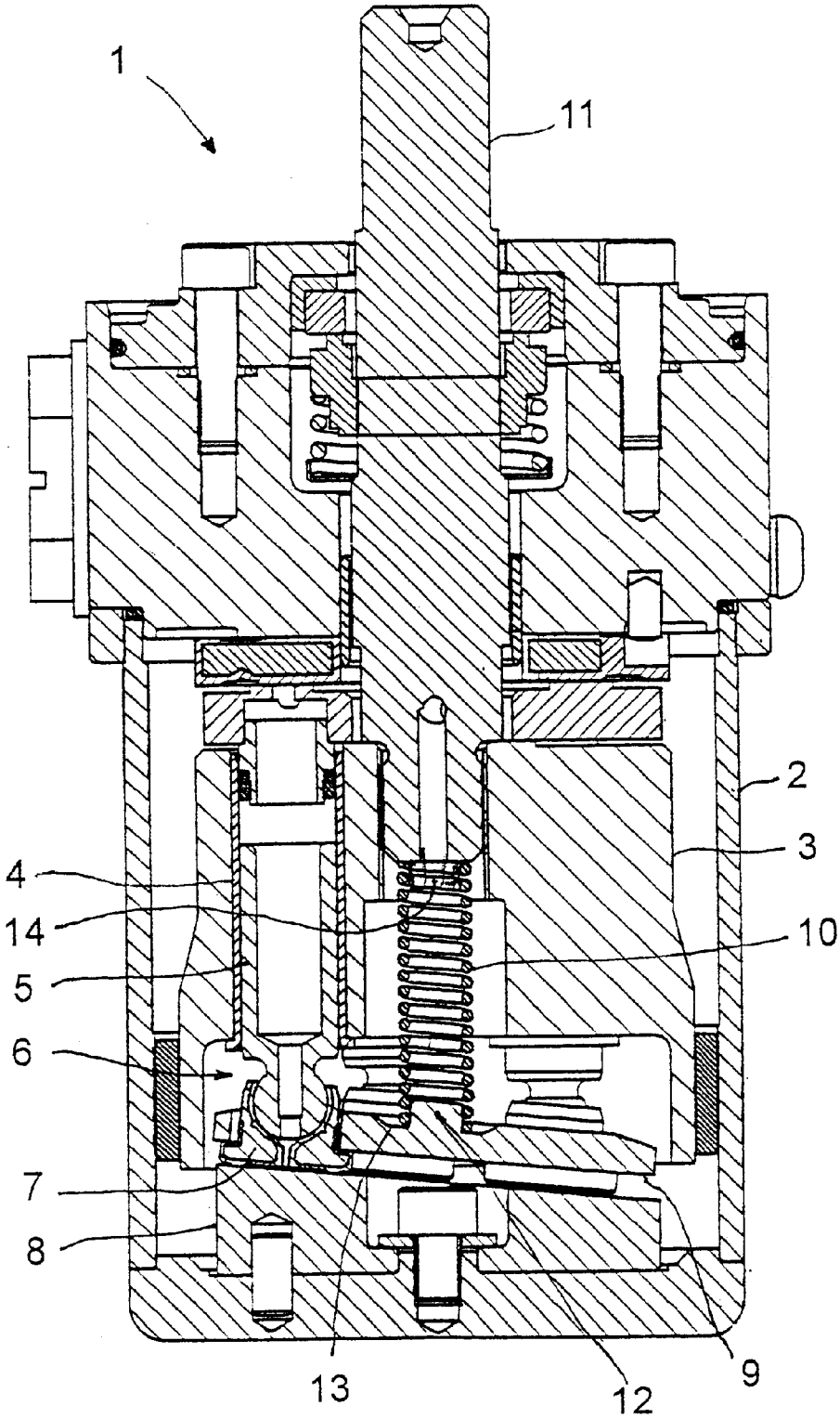
1
11
2
3
4
14
10
5
6
7
8
13
12
9

HYDRAULIC AXIAL PISTON MACHINE

The invention concerns a hydraulic axial piston machine with a cylinder drum, having at least one cylinder, in which a piston is arranged to be reciprocating, with a swash plate, on which the piston is supported via a slide shoe, with a pressure plate maintaining the bearing of the slide shoe on the inclined disc, and with a spring arrangement by means of which the pressure plate is pressed against the inclined disc via the cylinder drum.

In a known axial piston machine of this kind (see for example one of the following documents: DE-PS 433571, FR-PS 1314483, U.S. Pat. No. 2,733,666, U.S. Pat No. 5,032,061, DE-PS 628472) a ball joint is arranged between the spring arrangement and the pressure plate, which is submitted to a frictional wear.

The invention is based on the task of providing an axial piston machine as mentioned in the introduction, which has a simpler embodiment and in which such frictional wear is avoided.

According to the invention, this task is solved in that the spring arrangement bears immediately on the pressure plate.

With this embodiment, the ball joint and thus also the frictional wear in such a joint between pressure plate and spring arrangement can be avoided.

The spring arrangement may surround a projection of the pressure plate. Thus its position in relation to the pressure plate is secured.

Alternatively or additionally, the spring arrangement can also project into a recess in the pressure plate, adapted to it, to secure the position of the spring arrangement in relation to the pressure plate.

Preferably, it is additionally provided that the spring arrangement is supported on one end of a driving shaft penetrating the cylinder drum at least unrotatably.

Additionally, the spring arrangement can surround a projection on one end of the driving shaft to secure its position in relation to the driving shaft.

In the following the invention and its embodiments are described in detail on the basis of the drawing of a preferred embodiment.

The hydraulic axial piston machine 1 shown has a cylinder drum 3 arranged to be rotatable in a housing 2. In the cylinder drum 3 several cylinders 4 are arranged, of which only one can be seen in the sectional view. In each cylinder 4 a piston 5 is arranged to be reciprocating. The piston 5 is articulately connected with a slide shoe 7 via a ball joint 6. The slide shoe 7 bears on a swash plate 8. To maintain the bearing of the slide shoe 7 on the inclined disc 8, a pressure plate 9 is provided, which is supported on the cylinder drum 3 via a spring arrangement 10 and a driving shaft screw-coupled with the cylinder drum 3. In the rotation direction of the driving shaft 11, the driving shaft 11 is unrotatably connected with the cylinder drum 3.

The spring arrangement 10 consists of a cylindrical helical spring. However, it can also be made as a conical spring or have two springs arranged inside each other.

With its one end, the spring arrangement 10 surrounds a projection 12 of the pressure plate 9. At the same time it can engage in a recess 13 surrounding the projection 12 or in a recess in the pressure plate adapted to it, to secure the position of one end of the spring arrangement 10 in relation to the pressure plate 9. With its other end the spring arrangement 10 is supported on the end of the driving shaft 11 screwed into the cylinder drum 3, at the same time surrounding a projection 14 at this end to secure its position.

The spring arrangement 10 thus permits the drum movement of the pressure plate 9, while it is turned together with the cylinder drum 3 via the driving shaft 11. Thus, a ball joint between the driving shaft 11 and the pressure plate 9 or between the cylinder drum 3 and the pressure plate 9 is avoided, so that the corresponding wear of such a ball joint is avoided.

What is claimed is:

1. Hydraulic axial piston machine comprising a rotatable cylinder drum having at least one cylinder, a piston in the cylinder arranged to be reciprocating, and an inclined swash plate on which the piston is supported via a slide shoe and further including a rotatable pressure plate maintaining the bearing of the slide shoe on the swash plate and a spring arrangement by means of which the pressure plate is pressed against the swash plate via the cylinder drum, the spring arrangement bearing immediately on the pressure plate.

2. Machine according to claim 1, in which the spring arrangement surrounds a projection of the pressure plate.

3. Machine according to claim 1, in which the spring arrangement projects into a recess in the pressure plate.

4. Machine according to claim 1, in which the spring arrangement is supported on one end of a drive shaft extending into and unrotatable in relation to the cylinder drum.

5. Machine according to claim 1, in which the spring arrangement surrounds a projection on one end of the drive shaft.

* * * * *